US011087727B2

(12) United States Patent
Sugar et al.

(10) Patent No.: US 11,087,727 B2
(45) Date of Patent: Aug. 10, 2021

(54) AUTO-GENERATED ACCOMPANIMENT FROM SINGING A MELODY

(71) Applicant: SUGARMUSIC S.P.A., Milan (IT)

(72) Inventors: Filippo Sugar, Milan (IT); Jordi Janer, Barcelona (ES); Roberto Vernetti, Trino Vercellese (IT); Oscar Mayor, Barcelona (ES)

(73) Assignee: SUGARMUSIC S.P.A., Milan (IT)

( * ) Notice: Subject to any disclaimer, the term of this patent is extended or adjusted under 35 U.S.C. 154(b) by 0 days.

(21) Appl. No.: 16/500,262

(22) PCT Filed: Apr. 9, 2018

(86) PCT No.: PCT/EP2018/058983
§ 371 (c)(1),
(2) Date: Oct. 2, 2019

(87) PCT Pub. No.: WO2018/189082
PCT Pub. Date: Oct. 18, 2018

(65) Prior Publication Data

US 2020/0074966 A1 Mar. 5, 2020

(30) Foreign Application Priority Data

Apr. 10, 2017 (EP) ..... 17165762

(51) Int. Cl.
*G10H 1/00* (2006.01)
*G10H 1/26* (2006.01)
*G10H 1/36* (2006.01)

(52) U.S. Cl.
CPC ..... *G10H 1/0025* (2013.01); *G10H 1/26* (2013.01); *G10H 1/366* (2013.01);
(Continued)

(58) Field of Classification Search
CPC ..... G10H 1/0025; G10H 1/26; G10H 1/366; G10H 2210/005; G10H 2210/111;
(Continued)

(56) References Cited

U.S. PATENT DOCUMENTS 5,876,213 A * 3/1999 Matsumoto ..... G10H 1/366 434/307 A
7,309,826 B2 * 12/2007 Morley ..... G10H 1/368 84/483.1

(Continued)

FOREIGN PATENT DOCUMENTS

GB 2422755 A 8/2006

OTHER PUBLICATIONS

PCT International Search Report and Written Opinion dated Jun. 16, 2018 for Intl. App. No. PCT/EP2018/058983, from which the instant application is based, 15 pgs.

(Continued)

*Primary Examiner* — Jeffrey Donels
(74) *Attorney, Agent, or Firm* — Fredrikson & Byron, P.A.

(57) ABSTRACT

A method for processing a voice signal by an electronic system to create a song is disclosed. The method comprises the steps in the electronic system of acquiring an input singing voice recording (11); estimating a musical key (15*b*) and a Tempo (15*a*) from the singing voice recording (11); defining a tuning control (16) and a timing control (17) able to align the singing voice recording (11) with the estimated musical key (15*b*) and Tempo (15*a*); applying the tuning control (16) and the timing control (17) to the singing voice recording (11) so that an aligned voice recording (20) is obtained. Next, the method comprises the step of generating an music accompaniment (23) as function of the estimated musical key (15*b*) and Tempo (15*a*) and an arrangement
(Continued)

database (22) and mixing the aligned voice recording (20) and the music accompaniment (23) to obtain the song (12). A system a server and a device are also disclosed.

20 Claims, 7 Drawing Sheets

(52) U.S. Cl.
CPC .. *G10H 2210/005* (2013.01); *G10H 2210/111* (2013.01); *G10H 2240/251* (2013.01)

(58) Field of Classification Search
CPC ..... G10H 2240/251; G10H 1/40; G10H 1/44; G10H 2210/031; G10H 2210/051; G10H 2210/066; G10H 2210/071; G10H 2210/076; G10H 2210/081; G10H 2210/086; G10H 2210/251; G10H 2210/331; G10H 2210/391; G10H 2210/555; G10H 2240/121; G10H 2240/141; G10H 1/36; G10H 1/361; G10H 2210/341; G10H 2210/375
See application file for complete search history.

(56) References Cited

U.S. PATENT DOCUMENTS

| | | | | |
|---|---|---|---|---|
| 10,013,963 | B1 * | 7/2018 | Ka | G10H 1/0008 |
| 2006/0230910 | A1 * | 10/2006 | Song | G10H 1/0025 84/616 |
| 2008/0190271 | A1 * | 8/2008 | Taub | G10H 1/0058 84/645 |
| 2009/0064851 | A1 | 3/2009 | Morris et al. | |
| 2011/0054910 | A1 * | 3/2011 | Fujihara | G10L 15/26 704/278 |
| 2014/0074459 | A1 | 3/2014 | Chordia et al. | |
| 2014/0229831 | A1 | 8/2014 | Chordia et al. | |
| 2016/0210947 | A1 | 7/2016 | Rutledge et al. | |
| 2017/0025115 | A1 * | 1/2017 | Tachibana | G10L 13/0335 |
| 2017/0092246 | A1 * | 3/2017 | Manjarrez | G10H 1/0008 |
| 2018/0137845 | A1 * | 5/2018 | Prokop | G10H 7/00 |
| 2019/0051275 | A1 * | 2/2019 | Ka | G06F 16/634 |

OTHER PUBLICATIONS

Extended European Search Report dated Jul. 5, 2017 for related European Application No. 17165762.0, 10 pgs.

* cited by examiner

VARIATION 1

| | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| DRUMS A | D | D1 | D2 | | | | D3 | | | | D4 | | | | D2 | | | | D5 | | | | D6 | | | | D7 | | | | | | |
| BASS | B | 0 | B1 | | B1 | | B1 | | B2 | | B1 | | B1 | | B1 | | B1 | | B1 | | B2 | | B1 | | B1 | | B1 | | B1 | | B | | |
| PIANO BODY | PB | 0 | PB1 | | | | PB2 | | | | PB1 | | | | PB1 | | | | PB2 | | | | PB1 | | | | PB1 | | | | | | |
| PIANO TOP | PT | 0 | PT1 | | | | | | | | 0 | 0 | 0 | 0 | 0 | 0 | 0 | 0 | 0 | 0 | 0 | 0 | 0 | 0 | 0 | 0 | PT1 | | | | | | |
| STRINGS | ST | 0 | 0 | 0 | 0 | 0 | 0 | 0 | 0 | 0 | 0 | 0 | 0 | 0 | ST1 | | | | ST2 | | | | ST3 | | | | ST4 | | | | | | |
| GUITAR | G | 0 | 0 | 0 | 0 | 0 | G1 | | | | 0 | 0 | 0 | 0 | G2 | | | | G3 | | | | 0 | 0 | 0 | 0 | 0 | 0 | 0 | 0 | 0 | | |
| BRASS | BR | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | BR1 | | | | | | |
| VOCALS LEAD | VL | 0 | 0 | 0 | 0 | 0 | 0 | 0 | 0 | 0 | VOCALS | | | | 0 | 0 | 0 | 0 | 0 | 0 | 0 | 0 | VOCALS | | | | 0 | 0 | 0 | 0 | | | |
| VOCAL HARMONY 1 | | 0 | 0 | 0 | 0 | 0 | 0 | 0 | 0 | 0 | 0 | 0 | 0 | 0 | 0 | 0 | 0 | 0 | 0 | 0 | 0 | 0 | -3 | -3 | -3 | -3 | 0 | 0 | 0 | 0 | 0 | | |
| VOCAL HARMONY 2 | | 0 | 0 | 0 | 0 | 0 | 0 | 0 | 0 | 0 | 0 | 0 | 0 | 0 | 0 | 0 | 0 | 0 | 0 | 0 | 0 | 0 | 6 | 6 | 6 | 6 | 0 | 0 | 0 | 0 | 0 | | |

VARIATION 2

| | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| DRUMS A | D | 0 | 0 | 0 | D1 | D2 | | | | D5 | | | | 0 | 0 | 0 | D1 | D6 | | | | D7 | | | | D8 | | | | | | | |
| BASS | B | 0 | 0 | 0 | 0 | B1 | | B1 | | B1 | | B1 | | B1 | | B2 | | 0 | 0 | B1 | | B1 | | B1 | | B1 | | B2 | | B3 | | | |
| PIANO BODY | PB | PB2 | | | | PB1 | | | | PB1 | | | | PB2 | | | | PB1 | | | | PB1 | | | | PB2 | | | | PB9 | | | |
| PIANO TOP | PT | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | | |
| STRINGS | ST | ST9 | | | | 0 | 0 | 0 | | ST1 | | | | ST2 | | | | ST1 | | | | ST4 | | | | ST5 | | | | | | | |
| GUITAR | G | 0 | 0 | 0 | 0 | 0 | 0 | 0 | 0 | G1 | | | | G3 | | | | 0 | 0 | 0 | G2 | G3 | | | | G1 | | | | 0 | 0 | | |
| BRASS | BR | BR2 | | | | 0 | 0 | 0 | 0 | 0 | 0 | 0 | 0 | BR2 | | | | 0 | 0 | 0 | 0 | BR1 | | | | BR2 | | | | 0 | 0 | | |
| VOCALS LEAD | VL | 0 | 0 | 0 | 0 | VOCALS | | | | 0 | 0 | 0 | 0 | 0 | 0 | 0 | 0 | VOCALS | | | | 0 | 0 | 0 | 0 | 0 | 0 | 0 | 0 | | | | |
| VOCAL HARMONY 1 | | 0 | 0 | 0 | 0 | 0 | 0 | 0 | 0 | 0 | 0 | 0 | 0 | 0 | 0 | 0 | 0 | -3 | -3 | -3 | -3 | 0 | 0 | 0 | 0 | 0 | 0 | 0 | 0 | 0 | 0 | | |
| VOCAL HARMONY 2 | | 0 | 0 | 0 | 0 | 0 | 0 | 0 | 0 | 0 | 0 | 0 | 0 | 0 | 0 | 0 | 0 | 6 | 6 | 6 | 6 | 0 | 0 | 0 | 0 | 0 | 0 | 0 | 0 | 0 | 0 | | |

Fig. 6a

VARIATION 3

| | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|
| DRUMS A | D | D9 | | | D1 | D2 | | | | D5 | | | | D4 | | | | D7 | | | | D8 | | | | D9 | | | | | | | | 0 |
| BASS | B | 0 | 0 | 0 | 0 | B1 | | B1 | | B1 | | B2 | | B1 | | B1 | | B1 | | B1 | | B1 | | B2 | | B3 | | B9 | | | | | | 0 |
| PIANO BODY | PB | PB2 | | | | PB1 | | | | PB2 | | | | PB1 | | | | PB1 | | | | PB2 | | | | PB9 | | | | | | 0 | | 0 |
| PIANO TOP | PT | 0 | 0 | 0 | 0 | 0 | 0 | 0 | 0 | PT1 | | | | 0 | 0 | 0 | 0 | 0 | 0 | 0 | 0 | PT1 | | | | 0 | 0 | 0 | 0 | 0 | | | | 0 |
| STRINGS | ST | ST2 | | | | ST4 | | | | ST5 | | | | ST1 | | | | ST4 | | | | ST5 | | | | ST9 | | | | | | | | 0 |
| GUITAR | G | 0 | 0 | 0 | 0 | 0 | 0 | 0 | 0 | 0 | 0 | 0 | 0 | 0 | 0 | 0 | G2 | G3 | | | | G1 | | | | 0 | 0 | 0 | 0 | 0 | | | | 0 |
| BRASS | BR | 0 | 0 | 0 | 0 | BR1 | | | | BR2 | | | | 0 | 0 | 0 | 0 | 0 | 0 | 0 | 0 | 0 | 0 | 0 | 0 | 0 | 0 | 0 | 0 | 0 | | | | 0 |
| VOCALS LEAD | VL | VOCALS | | | | 0 | 0 | 0 | 0 | 0 | 0 | 0 | 0 | VOCALS | | | | 0 | 0 | 0 | 0 | 0 | 0 | 0 | 0 | VOCALS | | | | | | | | 0 |
| VOCAL HARMONY 1 | | 0 | 0 | 0 | 0 | 0 | 0 | 0 | 0 | 0 | 0 | 0 | 0 | -3 | -3 | -3 | -3 | 0 | 0 | 0 | 0 | 0 | 0 | 0 | 0 | 0 | 0 | 0 | 0 | 0 | | | | 0 |
| VOCAL HARMONY 2 | | 0 | 0 | 0 | 0 | 0 | 0 | 0 | 0 | 0 | 0 | 0 | 0 | 6 | 6 | 6 | 6 | 0 | 0 | 0 | 0 | 0 | 0 | 0 | 0 | 0 | 0 | 0 | 0 | 0 | | | | 0 |

Fig. 6b

AUTO-GENERATED ACCOMPANIMENT FROM SINGING A MELODY

RELATED APPLICATIONS

This application is a 35 U.S.C. 371 national stage filing from International Application No. PCT/EP2018/058983, filed Apr. 9, 2018, which claims priority to European Application No. 17165762.0, filed Apr. 10, 2017, the teachings of which are incorporated herein by reference.

The present invention generally relates to a system, device and method to process a voice and create a complete musical track. In particular, a system and method to create a musical track from a raw input singing voice is disclosed. According to the invention the voice is aligned and tuned and synthetic musical instruments are added so that a complete song is created with voice and accompaniment.

In particular, a method for automatic music production from voice recording is disclosed.

Advantageously, the system comprises a client as a mobile device (for example a smartphone) for inputting voice and preferences of the user and a remote server device for processing the voice and creating the complete song to be send back to the client device. In this manner, at least part of the voice processing is performed on a server and the resulting data is streamed to the mobile device and also mobile devices having relatively low computing power are usable to have a satisfying experience for the user.

Music signals are typically a combination of multiple sound sources instruments (e.g in an orchestra) or voices (e.g. in a choir) that play simultaneously following certain musical rules, e.g. harmony and rhythm. The combination will be pleasant to a listener when the different sound sources follow these rules and are musically coherent (same tempo and musical key), avoiding issues such as timing desynchronization or dissonances among the different sound sources.

Usually when a no-professional singer tries to sing a song he gets wrong tune and beat. Useful for a better result may be trying to sing on an existing musical base. In the prior art, many software exist in which a musical base is automatically performed and a user could try to sing on the base so that the user's voice is recorded and mixed with the base. However, if the singer sings badly then the result is very poor.

Other software try to derive the base directly by the melody sung by the user, but the pitch and tempo errors of the user often does not allow to obtain a satisfactory result. Software have been proposed in which it is attempted to remedy these defects, but they do not allow still to have a really satisfactory result and the mix of voice and music derived from the sung melody does not provide a complete musical track really usable as a professional-like musical track.

For example, US2014/229831 and US2014/074459 disclose methods in which a pre-existing 'meter or rhythm skeleton' is used. A user input recording is chopped in segments, where onset detection is used to determine each attack in the input signal and identify the segments, and the methods try to align each segment with the pre-selected rhythm skeleton.

GB2422755 discloses a method for synchronizing two audio signals to each other in which an input signal (usually, a cappella song) is regularized in key and tempo with an input reference signal. For example, singing on a pre-existing musical base can be improved by the method, but the result depends to the quality of the existing musical base.

US2016/210947 discloses a method in which an automatic transcription of audio signals containing music is obtained, i.e. an audio signal is converted in a musical notation (score). The generated score has additional musical information such as key, tempo and signature. The method generates a number of alternative notations (score and additional musical information) and a matching score to allow a user to select the most suitable notation. No new music is created or adapted from a singing, but the music is only converted in a corresponding musical notation and tempo and key very stable are necessary in the input signal (i.e. there must be a song or a music already "professional"). Therefore, it does not improve a song in the input signal but at most it adds a further accompaniment to the input signal.

It is a general aim of the present invention to have a method for processing a singing voice so that an appropriate music is created starting from the voice, the problem in the singing voice are corrected and the voice and music are mixed to obtain a complete musical track or song.

In view of the above aim, solutions are proposed according to any one claim of the present invention.

According to the invention, it is claimed a method according to claim 1.

The method for processing a voice signal by a programmed system to create a song, comprises the steps in the programmed system of acquiring an input singing voice recording; estimating a musical key and a Tempo from the singing voice recording; defining a tuning control and a timing control able to align the singing voice recording with the estimated musical key and Tempo; applying the tuning control and the timing control to the singing voice recording so that an aligned voice recording is obtained; generating an music accompaniment as function of the estimated musical key and Tempo and an arrangement database; mixing the aligned voice recording and the music accompaniment to obtain the song.

Moreover, according to other aspect of the invention, a server carrying out at least part of the method and able to be connected to voice input devices via internet connection is claimed.

Moreover, according to other aspect of the invention, it is claimed a system carrying out the method and comprising a device having a user interface, voice input means to input the singing voice recording and play means to play the song.

For better clarifying the innovative principles of the present invention and the advantages it offers as compared with the known art, a possible embodiment applying said principles will be described hereinafter by way of non-limiting example, with the aid of the accompanying drawings.

IN THE DRAWINGS

FIG. 6 is an example of an possible arrangement score of the present invention;

Figure 1:
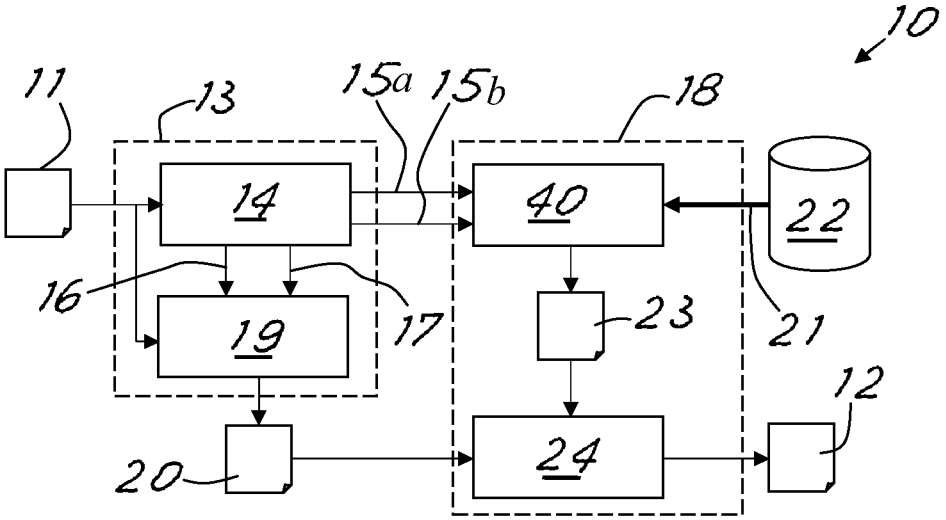
FIG. 1 is a block diagram of a system or method in accordance with the present invention.

With reference to the figures, FIG. 1 shows schematically an electronic system 10 carrying out a method for automatic music production from voice in accordance with the present invention. In substance, the system 10 has to process and mix an input voice source (Voice Recording) 11 with a generated instrumental source (Musical Accompaniment) so that a complete song 12 is produced avoiding timing desynchronization and/or dissonance. Voice and accompaniment need to be musically coherent to be mixed, otherwise music mix will sound unpleasantly out of tune and out of synchronization.

For example, the input voice can be acquired by a microphone or provided as audio file with a voice recording.

However, the musical quality of the input singing voice recording 11 could not be sufficient for a good result. Therefore, the system has to deal with input recordings that can be very badly sung, e.g. out of tune, unstable rhythm, etc.

According to the method, a first voice processing block 13 executes a voice processing of the input voice to align the input voice to be coherent to specific tempo and key, in order to mix it with a music accompaniment which is generated on the basis of these specific tempo and key.

The voice processing block 13 comprises a voice analysis block 14 to provide an estimated musical key and tempo data 15 and tuning control 16 and timing control 17.

As it will be further described below, tuning control 16 and timing control 17 are used to transform the input voice 11 by means of a voice transformation block 19 so that the voice becomes coherent in tuning and timing to the estimated musical Key scale and Tempo. Specifically, it ensures that the start time of the voice phrases are synchronized to beat locations and that an auto-tune pitch effect is applied to fit the Musical Key.

In this manner, the voice exits from the processing block 13 as an aligned voice recording 20 which is right in tune and tempo. Therefore, the musical quality of the singing voice recording is guaranteed.

Estimated key and tempo data 15 (or Tempo 15*a* and Key 15*b*) are also used to produce a right music accompaniment by an arranger block 18. The arranger block 18 comprises for example an arrangement generator block 40

The arrangement generator block 40 receives the estimated key and tempo data 15 from the block 13 and arrangement score and audio stems data 21 from an arrangement database 22 and produces a corresponding music accompaniment 23. For example, the user selects a Music Theme and the arranger block renders a music accompaniment track 23 following instructions in the arranger score taken from the arranger database 22.

Thereafter, the aligned voice recording 20 and the music accompaniment 23 are mixed in an automatic mixing block 24 so that the final generated song 12 is produced. For example, the mixing process follows the instruction in the arrangement score, which establishes the time position of the aligned voice recording 20, the corresponding mixing levels and audio FX to be applied to obtain the final output mix. If necessary, the aligned voice recording 20 can be also repeated in time so to convert a recording for example of few second into a full-length track of around for example 2-3 minutes as a commercial pop song production.

Figure 2:
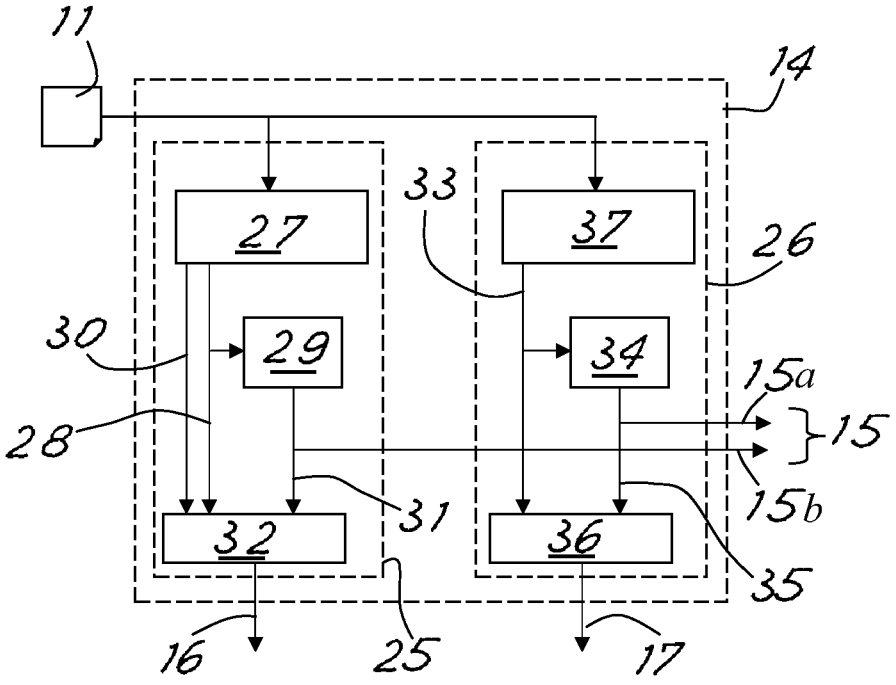
FIG. 2 is a block diagram of a part of voice analysis and alignment according to an aspect of the present invention.

Possible voice analysis process according to the invention is shown in more detail in FIG. 2.

As it will be further described below, this analysis consists in the analysis of the input user voice recording 11, extracting a number of 'musical descriptors' about its content, and estimating also the necessary alignment modifications in terms of tuning and timing.

In substance, the process can be advantageously divided in separate tuning and timing processes, marked as separate tuning block 25 and timing block 26.

For example, for the tuning correction the tuning block 25 extracts the pitch curve 30 of the voice input and estimates also a symbolic note transcription (sequence of musical notes as in a musical score or MIDI file) producing a symbolic notation 28 by means of an automatic melody transcription block 27. Then from the symbolic notation 28, an automatic key estimation block 29 estimates a musical key (e.g. A major) 31 of the input recording based on the note occurrences for a given musical scale.

An auto-tune block 32 receives three inputs, the pitch curve 30 over time, the note transcription in form of symbolic notation 28 and the estimated musical key 31. Based on these data, the auto-tune block 32 computes the necessary pitch correction to be applied to the input voice in order to be sound tuned in a given musical key. The output (Tuning Control 16) of the auto-tune module is a time-series containing for example the transposition values in semitone cents (1/100 semitone). The estimated key 31 can be advantageously used as Key 15*a* for the arrangement generation.

For the timing correction, the first step can be the estimation of vowel onsets 33. The vowel onsets are a list of time values indicating the beginning of syllables. This step is performed in a onset detection block 37.

Figure 3:
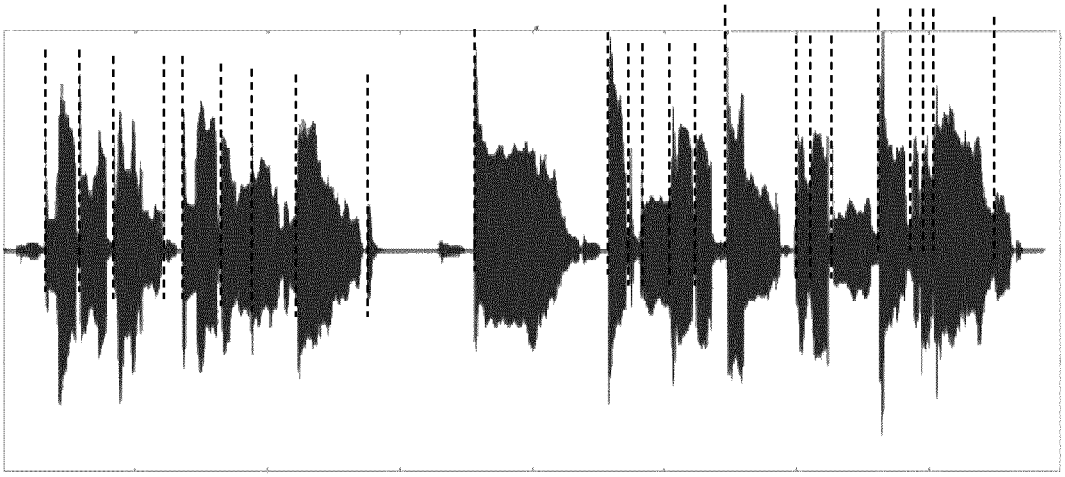
FIG. 3 is a graphic of a first processing of the voice according to an aspect of the present invention.

The tempo value in beats-per-minute is estimated in an automatic tempo estimation block 34. The estimation in the block 34 is based on auto-correlation of an onset function time-series as shown for example in FIG. 3 by vertical broken lines on the input voice recording waveform, as in se known by the technician. In substance, pauses and levels of the audio signal can be used to define Tempo value in the input voice recording.

The estimated Tempo 35 can be advantageously used as Tempo 15*a* for the arrangement generation.

Starting from the estimated tempo 35 and the list of onset 33, a time-alignment block 36 computes the time-alignment correction to be applied as timing control 17 using the common time-series analysis method named Dynamic Time Warping (DTW). This method can be used to align two sequences of values. We align the onset function to a function containing values spaced at sub-multiples of the beat locations (sixteenth note, eighth note, and quarter note). This allows aligning the peaks of the onsets to a tempo-quantized grid. The output is a time mapping function (Timing Control 17) as a sequence of pairs, where a input times sequence has a corresponding output time value <time_in, time_out>.

Once we have obtained from the voice analysis block 14 the tuning control 16 and the timing control 17, it is possible to transform the input voice recording to match the target tempo and key by the voice transformation block 19 in which an in se known algorithm manipulates the voice recording driven by the tuning control 16 and the timing control 17. In substance, the algorithm modifies the fundamental frequency and duration of the voice signal elements in fine detail. The result is an output audio signal, for example stored as a WAV file.

Figure 4:
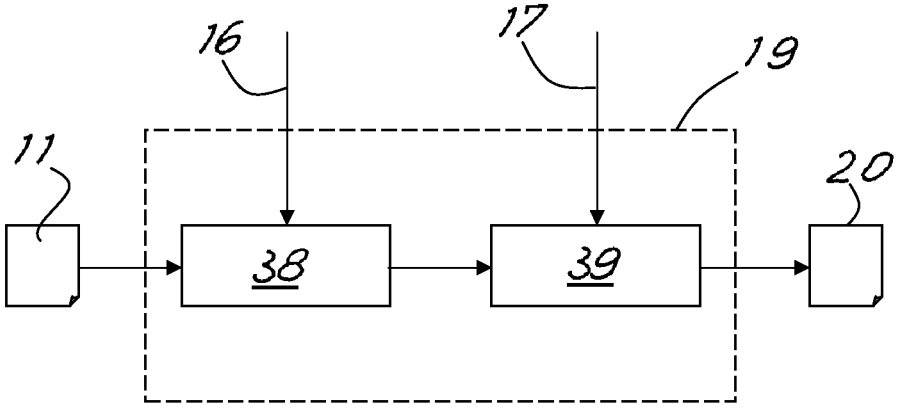
FIG. 4 is a block diagram of a part of voice transformation according to an aspect of the present invention.

For example, with reference to the FIG. 4, first, a pitch-shifting block 38 is commanded by the tuning control 16 so that the algorithm transposes the frequencies of the input voice recording and, after, a time-scaling block 39 is commanded by the timing control 17 so that the algorithm scales in time the duration of each elements of the input voice recording and the aligned voice recording is finally produced and it can be mixed with the corresponding music accompaniment 23.

Figure 5:
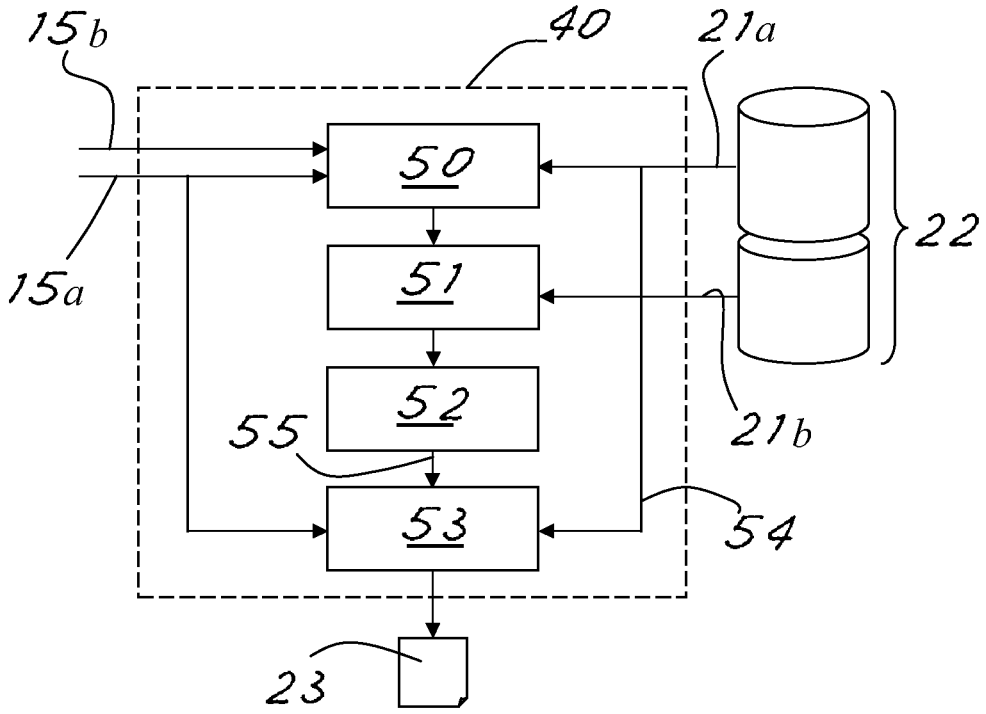
FIG. 5 is a block diagram of an arrangement generator according to an aspect of the present invention.

A more detailed example of the arrangement generator block 40 creating the music arrangement 23 is shown in FIG. 5.

As above disclosed, the arrangement generator block 40 produces an instrumental musical accompaniment 23 that can be mixed with the aligned voice recording 20. For example, the musical accompaniment 23, or arrangement, can be generated based on instructions (arrangement score 21*a*) and audio or arrangement stems 21*b* (e.g. audio loops) stored in an arrangement database 22. Each arrangement (score and stems) has an original tempo and key (e.g 90 bpm and A major). Arrangement score 21*a* and arrangement stems 21*b* form the above mentioned arrangement score and audio stems data 21.

For example, the arranger scores can be score text files (i.e. a sequence of instructions in text files) and the audio stems can be audio files.

As shown in FIG. 5, the arrangement generator block 40 receives the values of Tempo and Key data 15 and loads in load score block 50 one arrangement score 21*a* (for example an instructions text file) from the database 22 that is appropriate to the specified Tempo and Key. For example, if the estimated user voice tempo is 88 bpm, we will load the Arrangement Score that has the closest original tempo (e.g. 90 bpm). The Arrangement Score 21*a* contain detailed instructions about the tracks to be rendered from audio stems, which are specified with unique IDs (for example, electricguitar01, drums05, brass06), and the exact begin and end times, given for example in bars:beats. Next step is to load in the load stem block 51 the necessary audio stems 21*b* from the database 22. Starting from loaded score and audio stem, a render arrangement block 52 renders the arrangement.

The rendering step can be seen as a virtual multitrack session in a typical Digital Audio Workstation (e.g. ProTools, Cubase), where we have the audio stems located in different tracks over time. The block 52 mixes the different stems over time, generating an output audio signal, for example a stereo audio signal. The last step in the arrangement generator block 40 is to time-scale the music accompaniment to exactly match the voice recording tempo 15*a*, (for example 88 bpm). The time scaling block 53 receives in input the tempo 15*a* as a target tempo, the arrangement tempo 54 (from the arrangement score) and the music arrangement 55 from the render arrangement block 52, and outputs the music accompaniment 23 matched the aligned voice recording 20. It is possible to use an existing polyphonic audio time-scaling algorithm to store the output Music accompaniment 23 as, for example, a Music Accompaniment file.

An arrangement score can be designed in many different manner as it is clear at the technician by the above explanation.

In FIG. 6 an example of a possible arrangement score file is shown. The arrangement file in the example is a score with mixing instructions, similar to a mulitrack view in a DAW (Digital Audio Workstation), where the multiple instrumental stems and vocal track excerpts are combined. For example, it can be stored in XLSX (MS Excel format), or a CSV (Comma separated value) format. In substance, the arrangement score can be a table with in each rows an instrument with a sequence of note and duration (as multiple of a basic length), as clear in FIG. 6. The arrangement score can also comprise some variations.

The final mixing block 24 combines the aligned voice recording 20 with the music accompaniment track 23. Advantageously, this block 24 estimates automatically the mixing levels of the music and voice input to produce a well-balanced downmix as result.

Figure 7:
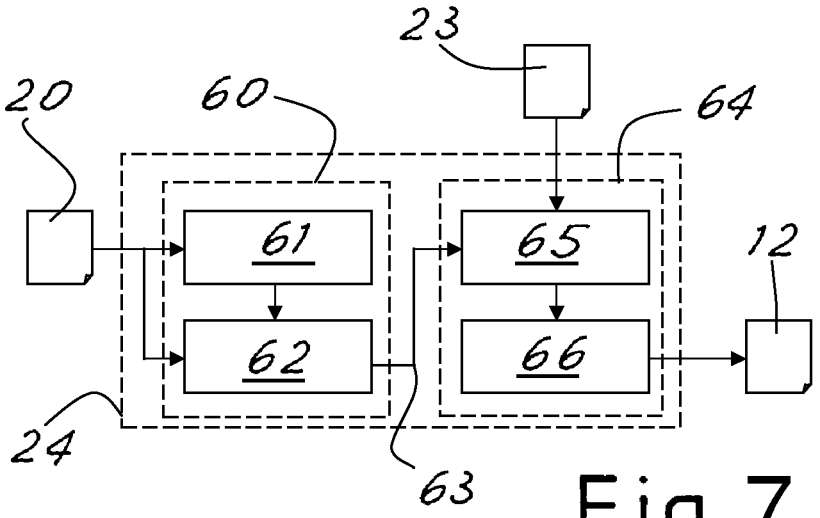
FIG. 7 is a block diagram of an automatic mixing according to an aspect of the present invention.

As shown in FIG. 7, the mixing block 24 can comprise for example two steps or blocks 60 and 64 in sequence. However, if preferable, only one step or block 60 or 64 can be present or used.

The first step is eventually to generate additional effects on the aligned voice recording 20. For example, additional vocal tracks (VoiceFX tracks) can be generated in a block 60 starting from the aligned voice recording 20. The purpose is to build a more complex downmix with harmonies, and other audio effects as typically used in commercial music production.

Advantageously, the first block 60 is a vocal FX track generation block. This block 60 can comprise a FX track block 61 and a vocal mix and FX block 62. The FX track block 61 creates FX tracks, for example using adapted instructions found in the Arrangement Score 21*a*. For example, the FX track block 61 can create effects as harmonization, delay, edit, etc.

Next, these FX tracks are mixed together with the input Aligned Voice Recording using eventually other effects as compression and reverb in the vocal mix and FX block 62. The processed voice recording 63 produced by the vocal FX track generation block 60 is applied to the final block 64 or Downmix block 64. This block 64 comprises a level adjustment block 65 in which the levels (loudness) of both inputs the vocal track 63 and the music accompaniment 23 are estimated. Based on this values the block 64 applies gains to obtain the desired balance, advantageously specified in the Arrangement Score 21*a* and the balanced signals are mixed in the mixing block 66. The output from this mixing block 66 is the final full-length song 12.

The effects applied can be automatically selected (for example, as function of the selected accompaniment score) or selected by the user.

At this point it is apparent how the intended purposes are achieved and how a method according to the present invention can be implemented.

Using the method as above disclose with reference to the electronic system 10 of the present invention, a user records a Vocal Recording (singing voice melody) using a device with microphone (for example a smartphone) or providing an audio file with a voice recording. The user can record, playback the recording, discard and repeat the recording if the user thinks it to be not satisfactory. The recording can be short (for example, 10-20 seconds). Moreover, the user can also eventually select a "Music Theme" (e.g. musical genre/style) for the output Produced Song. For example, the Music Theme can be selected from a list of candidates, which can be available on an app GUI (for example, a combo box). When the recording and the optional selection of theme are completed, the user starts the audio processing.

The Voice Recording is automatically processed and mixed on top of a Music Accompaniment (instrumental music track) according to the selected Music Theme as above disclosed.

Finally, the user listens to the generated song and can repeat the process and go back to initial step to try a different voice recording or selecting a different music theme.

The method according to the invention can be implemented on a suitable device as you can now easily image after the above disclosure of the invention. The device can be a device specifically made or it can be a suitable known device of the type programmable for various application and properly programmed to implement the invention, as it will be easily understands by the technician when he reads the present description of the invention. For example, the device may be a tablet PC, a smartphone, laptop, notebook, computer desktop, etc. In substance, the device (for example a device 70 in FIGS. 8 and 9) can comprise a user interface 72, voice input means 71, 77 to input the singing voice recording 11 and player means 75, 76 to play the song 12. The device can also comprise known processing means (a microprocessor, memory, etc.) programmed to process the audio signal as above disclosed so that the inventive method is operated. Input means can comprise a microphone and/or a memory in which a pre-recorded singing voice recording is stored.

The general architecture of such a device is per se well known and easily imaginable by the technician. Therefore, it is not further described or shown herewith.

Processing may also be divided up, being performed partly in a remote computer and partly in the device. If preferred, the device can be used as input voice device and the processing of the voice can be operate on a remote unit of the system. By assigning all or part of the data processing to a remote unit it is possible to obtain a portable device which may be, for example, less powerful or therefore less costly.

In any case, the method according to the invention can be implemented at least in part with an APP or software installed in a portable device.

A client-server architecture can also be used, so that other parts of the method eventually can be implemented with a software installed in a remote server.

For example, client-server architecture can be particularly useful in case of a device having relatively low computing power and/or a local memory too small for the arrangement database. For example, a smartphone (or other device) can execute a client program in which is implemented the user interface and an audio pre-processing for sending the user's preferences and the voice recording to a server. The server carries out the complete analysis, transformation, arrangement generation, mixing and send back to the smartphone (or other device) the generated song so that the smartphone (or other device) reproduces the song. Moreover, a client-server architecture can be useful to centralize the voice processing and/or the accompaniment generation for many client device.

Figure 8:
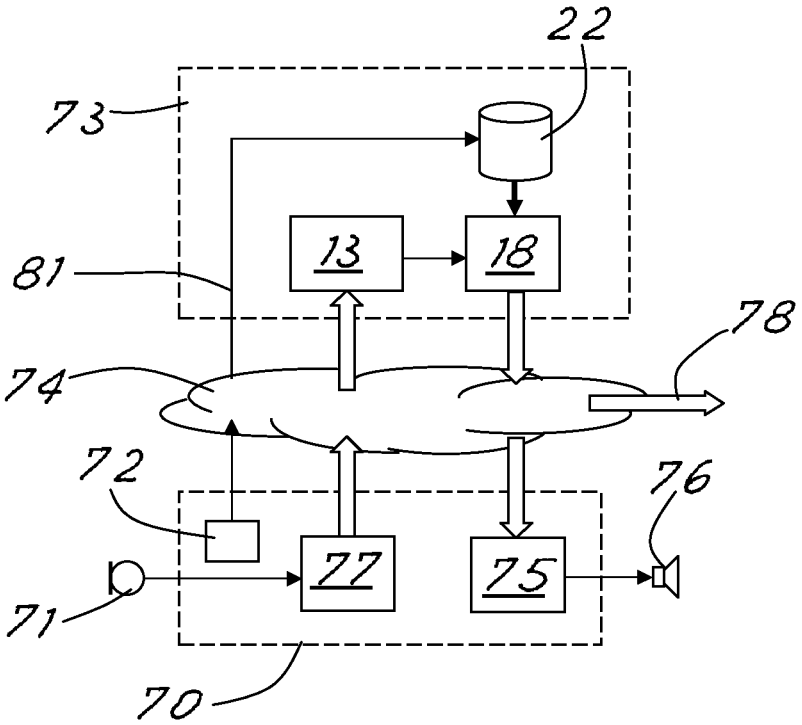
FIG. 8 is a block diagram of a possible client-server architecture of the system according to the invention.

FIG. 8 depicts an example of an client-server architecture according to the present invention.

The Client software on the client device 70 (for example a smartphone or like) records the voice (for example user's voice by means of a microphone 71) and its internal recorder or store circuits 77 and acquires the user's preferences 81 by means of a user interface 72 (for example a display and a keyboard or a touchscreen). In a possible client server architecture, the client device 70 uploads the recording and the user's preferences to a server 73 using standard internet connection 74.

The Server software on the server 73 carries out the voice processing, arrangement generation and mixing by means of the voice processing block 13 and the arranger block 18 as above disclosed and sends the result, for example as an audio file, back to the client via the standard internet connection 74. The generated song can be also published on the web, for example as public URL 78 and/or audio file (for example, a mp3 file).

The client uses its play means (for example well known internal audio circuits 75) to reproduce the generated song via a speaker or headphone 76.

In order to make the system more efficient and scalable when used by hundreds users simultaneously, the method implementation can be partially transferred to the client, if the client device is sufficiently powerful. This would transfer part of the computational load from the Server to the Client, for example reducing the necessity of powerful servers, internet traffic and the associated costs.

Figure 9:
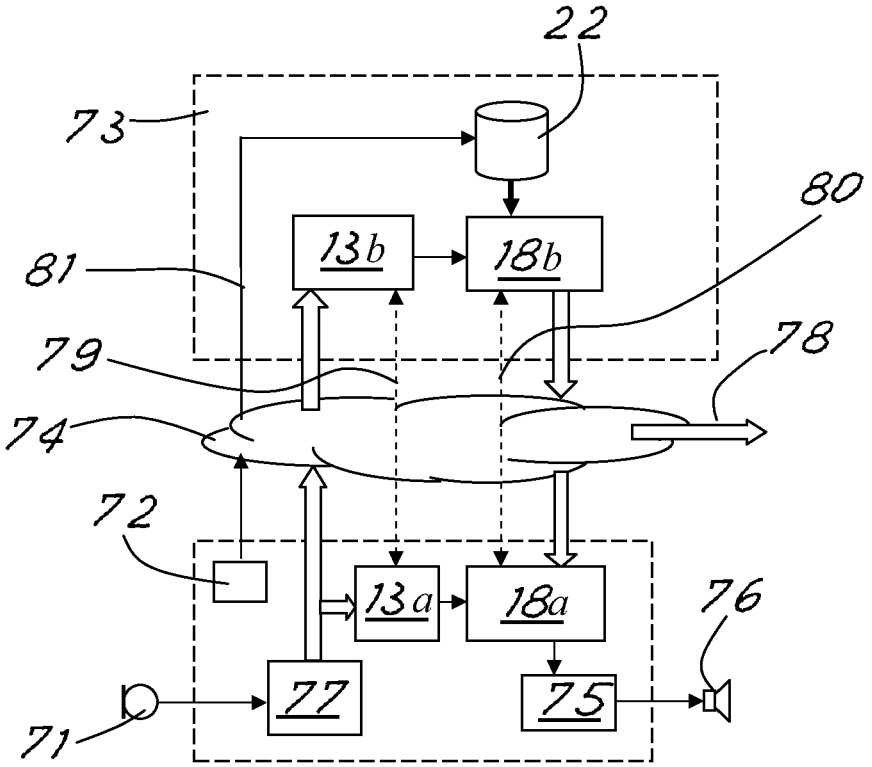
FIG. 9 is a block diagram of a possible other client-server architecture of the system according to the invention.

FIG. 9 depicts other example of an client-server architecture according to the present invention where part of the computational load is transferred into the client device 70.

In substance, the voice processing block 13 can be divided in two part, a first part 13*a* in the client and a second part 13*b* in the server. The two parts 13*a* and 13*b* communicates via the internet connection 74 exchanging corresponding date and messages 79. For example, the first part 13*a* can comprise voice analysis and the second part 13*b* can comprise voice transformation and date and messages 79 comprise the tuning and timing controls.

The arranger block 18 can be divided in two part too, a first part 18*a* in the client and a second part 18*b* in the server. The two parts 18*a* and 18*b* communicates via the internet connection 74. The two parts 18*a* and 18*b* communicates via the internet connection 74 exchanging corresponding date and messages 80. For example, the first part 18*a* can comprise automatic mixing and the second part 18*b* can comprise the arrangement generator block connected to the arrangement database in the server. Date and messages 80 can comprise music accompaniment However, other distribution of the computational load can be used if it is preferable for example to minimize the computational load in mobile devices or to minimize data exchange.

For example, the entire voice processing block 13 could be transferred into the client and only the arrangement generator block being into the server so that the music accompaniment is sent to the client and the client mixes the received music accompaniment with the local produced aligned voice recording.

Client-server architecture is also useful to have a large and high quality arrangement database. In fact, an arrangement database 22 on a server can be easily maintained up-to date and very large number of instruments of high musical quality can be stored in the database. Moreover, many device 70 can be connected to one server and the server can advantageously attend to many device 70.

In any case, a web site connected to the server 73 could be used to publish generated songs so that the musical productions of the users can be spread among the users.

In this case, the web site can be also a web interface permitting to the users to create professional-like musical tracks using the method according to the invention and publish the generated songs.

At this point it is clear how the predefined objects have been achieved. The method according the invention actually estimates how input tempo evolves over time, and does the alignment accordingly.

Tempo estimation and alignment is obtained in a continuous way and the problem of desynchronization of any acapella singing input recording, for example by an amateur user, is solved and a correspondence between a singing and a music accompaniment is obtained without timing desynchronization and/or dissonances.

For example, the method performs a dynamic analysis, estimating a continuous tempo curve over time (pairs of time, BPM values). This tempo curve is used to generate the actual tempo grid before the analysis step. Therefore the tempo grid will not be equally spaced. Instead the grid separation will depend on the tempo value at each time. The onset alignment step uses this dynamic tempo grid with the goal to synchronize onsets with beat locations in the tempo grid using for example a dynamic programming (DTW algorithm) how now clear to the technician.

Good singing and a corresponding complete music accompaniment are reached starting from a input signal which can be, for example, an erroneous and/or no professional acapella singing input recording.

Obviously, the above description of an embodiment applying the innovative principles of the present invention is provided by way of example of these innovative principles and must therefore not be regarded as limiting the scope of the rights claimed herein. For example, it should be noted that the system according to the invention can be self contained in a mobile device other in a client-server architecture. However, thanks to a system connected to a network, multiple users, each with its own device, can interact with each other. The method according to the present invention can be carried out with other devices and elements per se well-known and easily imaginable by the technician, and which can be appropriately programmed or adapted to perform the method of the invention. Many other embodiments will be apparent to those of skill in the art upon reviewing the above description. Other embodiments may be utilized and derived therefrom, such that structural and logical substitutions and changes may be made without departing from the scope of this disclosure.

Obviously, the method and the system or device may include other facilities for the user, as now easily understandable for the technician on the basis of the present description of the principles of the invention. For example the system can process the data according to a locally stored set of user preferences and/or show in visual graphical manner the voice analysis, accompaniment generation, mixing, etc.

The invention claimed is:

1. A method for processing a voice signal by an electronic system to create a song, wherein the method comprising the steps in the electronic system of:

acquiring an input singing voice recording;

estimating a musical key and a Tempo from the singing voice recording;

defining a tuning control and a timing control able to align the singing voice recording with the musical key and Tempo;

applying the tuning control and the timing control to the singing voice recording to obtain an aligned voice recording;

generating an music accompaniment as function of the estimated musical key and Tempo and an arrangement database; and mixing the aligned voice recording and the music accompaniment to obtain the song;

wherein the step of defining a timing control comprises the further steps of:

estimating vowel onsets from the singing voice recording;

estimating an estimated Tempo from the estimated vowel onsets;

producing the timing control as function of the estimated vowel onsets and the estimated Tempo.

2. The method according to claim 1, wherein the step of defining a tuning control comprises the further steps of:

estimating a symbolic note transcription from the singing voice recording to produce a symbolic notation correlated to a melody contained in the singing voice recording;

estimating a pitch curve over time and an estimated musical key from the symbolic notation;

producing the tuning control as function of the estimated pitch curve, the estimated musical key and the symbolic notation.

3. The method according to claim 2, wherein the estimated musical key 31 is used as the estimated musical key is used as the musical key.

4. The method according to claim 1, wherein the estimated Tempo is used as the Tempo.

5. The method according to claim 1, wherein a pitch-shifting is applied to the singing voice recording as function of the tuning control and a time-scaling is applied to the singing voice recording as function of the timing control to obtain the aligned voice recording.

6. A method for processing a voice signal by an electronic system to create a song, wherein the method comprising the steps in the electronic system of:

acquiring an input singing voice recording;

estimating a musical key and a Tempo from the singing voice recording;

defining a tuning control and a timing control able to align the singing voice recording with the musical key and Tempo;

applying the tuning control and the timing control to the singing voice recording to obtain an aligned voice recording;

generating an music accompaniment as function of the estimated musical key and Tempo and an arrangement database; and mixing the aligned voice recording and the music accompaniment to obtain the song;

wherein the step of generating the music accompaniment comprises the steps of:

loading an arrangement score and arrangement stems from the arrangement database;

rendering an musical arrangement based on the loaded arrangement score and arrangement stems;

time-scaling the musical arrangement to match the Tempo so that the music accompaniment is obtained.

7. The method according to claim 1, wherein the step of mixing the aligned voice recording and the music accompaniment comprises in sequence the steps of:

adjusting the levels of the aligned voice recording and the music accompaniment;

mixing the aligned voice recording and music accompaniment with adjusted levels.

8. The method according to claim 1, wherein before the step of mixing the aligned voice recording and the music accompaniment there is a further step of applying effects to the aligned voice recording.

9. A system carrying out the method of claim 1 and comprising a device having a user interface, voice input means to input the singing voice recording and play means to play the song.

10. The system according to claim 9, characterized in one or more of that the input means comprises a microphone and/or the play means comprises a speaker or headphone.

11. The system according to claim 9, characterized in that the device is a tablet, smart phone or computer.

12. The system according to claim 9, characterized by a client-server architecture having the client based on at least one said device and a server connected the device by an Internet connection.

13. The system according to claim 12, characterized in that the server comprises at least part of a voice processing block and at least part of an arrangement generator block and the arrangement database.

14. The system according to claim 12, characterized in that the client-server architecture comprise a web site to publish the songs.

15. A server carrying out at least part of the method of claim 1 and able to be connected to voice input devices via internet connection.

16. The method according to claim 6, wherein a pitch-shifting is applied to the singing voice recording as function of the tuning control and a time-scaling is applied to the singing voice recording as function of the timing control to obtain the aligned voice recording.

17. The method according to claim 6, wherein the step of mixing the aligned voice recording and the music accompaniment comprises in sequence the steps of:

adjusting the levels of the aligned voice recording and the music accompaniment;

mixing the aligned voice recording and music accompaniment with adjusted levels.

18. The method according to claim 6, wherein before the step of mixing the aligned voice recording and the music accompaniment there is a further step of applying effects to the aligned voice recording.

19. A system carrying out the method of claim 6 and comprising a device having a user interface, voice input means to input the singing voice recording and play means to play the song.

20. A server carrying out at least part of the method of claim 6 and able to be connected to voice input devices via interne connection.

* * * * *